US007988476B2

(12) United States Patent
Billman et al.

(10) Patent No.: US 7,988,476 B2
(45) Date of Patent: Aug. 2, 2011

(54) SEALED PLUG ASSEMBLY

(75) Inventors: Timothy Brian Billman, Dover, PA (US); Scott David Harnish, Lancaster, PA (US)

(73) Assignee: Souriau USA, Inc., York, PA (US)

( * ) Notice: Subject to any disclaimer, the term of this patent is extended or adjusted under 35 U.S.C. 154(b) by 0 days.

(21) Appl. No.: 12/756,258

(22) Filed: Apr. 8, 2010

(65) Prior Publication Data

US 2010/0261367 A1 Oct. 14, 2010

Related U.S. Application Data

(60) Provisional application No. 61/167,975, filed on Apr. 9, 2009.

(51) Int. Cl.
*H01R 13/52* (2006.01)

(52) U.S. Cl. ..... 439/271; 439/462

(58) Field of Classification Search ..... 439/271, 439/274, 275, 462, 543, 322, 349
See application file for complete search history.

(56) References Cited

U.S. PATENT DOCUMENTS

| | | | | |
|---|---|---|---|---|
| 6,010,348 | A * | 1/2000 | Alden | 439/274 |
| 6,409,532 | B2 * | 6/2002 | Payson et al. | 439/320 |
| 6,435,911 | B1 | 8/2002 | Payson et al. | |
| 6,537,104 | B1 * | 3/2003 | Kuhn et al. | 439/462 |
| 6,582,248 | B2 * | 6/2003 | Bachman | 439/462 |
| 6,817,902 | B2 * | 11/2004 | Bernardi et al. | 439/676 |
| 7,097,486 | B2 * | 8/2006 | Parsons | 439/291 |
| 7,303,418 | B2 * | 12/2007 | O'Connor | 439/277 |
| 7,316,583 | B1 * | 1/2008 | Mistarz et al. | 439/589 |
| 7,857,647 | B2 * | 12/2010 | Bracci et al. | 439/282 |

* cited by examiner

*Primary Examiner* — Hae Moon Hyeon
(74) *Attorney, Agent, or Firm* — McNees Wallace & Nurick LLC

(57) ABSTRACT

A protective plug assembly for use with a Universal Serial Bus (USB) connector. The plug assembly is installed over a terminated USB connector and provides additional shielding for the USB connector, thereby allowing the USB connector to be used in military, aerospace, industrial or other applications in which signal degradation is a concern. The plug assembly is easily installed in the field, as the plug adapter assembly may be preassembled during manufacture. The plug assembly also provides sealing for the USB connector which allows the USB connector to be used in environmental conditions which are not conducive to the longevity of an unprotected connector.

20 Claims, 6 Drawing Sheets

SEALED PLUG ASSEMBLY

FIELD OF THE INVENTION

The invention relates to connector assemblies for connectors for electronic data cables and, more particularly, to connector assemblies for Universal Serial Bus (USB) connectors which may be installed in the field to protect the USB connectors.

BACKGROUND OF THE INVENTION

Transmission by cable of electronic data between computational systems is well known. Such cable typically employs a multi-channel end plug or connector, such as an RJ-45 connector or a USB connector. In some applications, these connectors are vulnerable to damage and failure.

U.S. Pat. No. 6,582,248 discloses a system for protecting a cable connector, and especially an RJ-45 cable connector, from damage or abuse during use with a chassis receptacle. A cylindrical carrier housing for the connector contains a transverse septum having a shaped opening for receiving and positioning the connector within the housing. A radially-compressible chuck on the cable compresses to grip the cable. A boot on the cable and protrudes from the housing through an overriding bushing threadedly connected to the housing. The boot isolates the cable from flexural stresses. When the bushing is tightened onto the housing, the boot is urged toward the housing, radially compressing the chuck onto the cable. Longitudinal stresses on the cable are therefore isolated from the connector and are transferred instead to the housing. A mating chassis receptacle is receivable of the connector and has an annular groove on an axial face thereof for receiving and rotationally positioning the housing for insertion into the receptacle. A releasable spring catch on the receptacle arrests the housing after electrical contacts between the connector and the receptacle have been established.

In some applications, such as in military, aerospace and industrial settings, the USB connector may be subjected to harsh environments. In these environments, the USB connectors may be exposed to harmful physical conditions, including moisture, as well as harmful electrical conditions such as electrical interference from machines and the like. These conditions may result in physical damage to the USB connector or in a degradation of the performance of the USB connector and signal. It would, therefore, be beneficial to provide a plug assembly which could cooperate with the USB connector to protect the USB connector, and the electrical interconnection thereof, from physical damage and which would provide additional shielding to help prevent electrical interference from affecting the performance of the USB connector.

SUMMARY OF THE INVENTION

One aspect of the invention is directed to a plug assembly for housing a USB connector. The plug assembly has a protective shell which has an opening dimensioned to receive the USB connector and attached cable therethrough. A sealing member is provided and is dimensioned to be received in the opening of the protective shell. The sealing member has a connector receiving opening which extends from a front surface of the sealing member to proximate a back surface of the sealing member. The connector receiving opening is tapered such that diameter of the connector receiving opening is larger proximate the front surface and smaller proximate the back surface. The plug assembly also has a plug adapter assembly which has a plug body, a seating member and a mating assembly. The plug body has a generally cylindrical opening which extends therethough and which is dimensioned to receive the USB connector therein. The seating member has a positioning opening which is dimensioned to cooperate with a mating portion of the USB connector. The mating assembly has a mating opening for positioning the seating member, the mating opening is dimensioned to engage a mating connector and to properly position the mating portion of the USB connector relative to the mating connector. The protective shell, the sealing member and the plug adaptor can be installed on the USB connector after the USB connector has been terminated to the cable.

Another aspect of the plug assembly is directed to the enhanced shielding. The protective shell having an opening which is dimensioned to receive the USB connector and attached cable therethrough. The sealing member is dimensioned to be received in the opening of the protective shell. The sealing member has a connector receiving opening which extends from a front surface of the sealing member to proximate a back surface of the sealing member. The connector receiving opening is tapered such that diameter of the connector receiving opening is larger proximate the front surface and smaller proximate the back surface. The plug adapter assembly has a seating member and a ground member, with the ground member having inner tabs and outer tabs. The inner tabs extend from a ground member opening which is dimensioned to receive the mating portion of the USB connector therethrough. The outer tabs are formed about the perimeter of the ground member and are bent to extend toward the plug body. The seating member has a seating opening dimensioned to receive the inner tabs of the grounding member therein. This allows a conductive shell of the USB connector to be placed in electrical engagement with a shell of the plug adapter assembly via the inner and outer tabs of the system ground, providing a grounding path to between the USB connector and a mating connector to which the plug adapter assembly is mated.

Another aspect of the plug assembly allows the plug assembly and USB connector to be used in environmentally harsh conditions. The protective shell has an opening which is dimensioned to receive the USB connector and attached cable therethrough. The sealing member is dimensioned to be received in the opening of the protective shell. The sealing member has a connector receiving opening which extends from a front surface of the sealing member to proximate a back surface of the sealing member. The connector receiving opening is tapered such that diameter of the connector receiving opening is larger proximate the front surface and smaller proximate the back surface. The plug adapter assembly has a plug body and a mating assembly. The plug body has a generally cylindrical opening which extends therethough and which is dimensioned to receive the USB connector therein. The mating assembly has a mating opening for positioning a mating portion of the USB connector relative to a mating connector. A first compressible member is positioned between the plug body and the mating assembly to provide a seal therebetween. A second compressible member is provided between the plug body and the protective shell to provide a seal therebetween. The sealing member, the first compressible member and the second compressible member provide the plug assembly with sealing to protect the USB connector in harsh environmental conditions.

Other features and advantages of the present invention will be apparent from the following more detailed description of the preferred embodiment, taken in conjunction with the accompanying drawings which illustrate, by way of example, the principles of the invention.

DESCRIPTION OF THE INVENTION

Figure 2A:
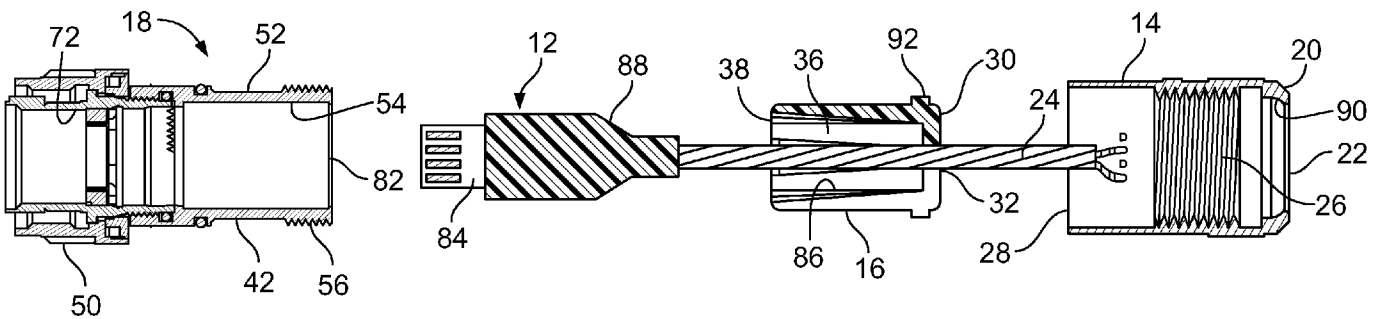
FIG. 2A is an exploded cross-sectional view of the plug assembly of FIG. 2, with the plug adaptor assembly assembled.
Figure 2:
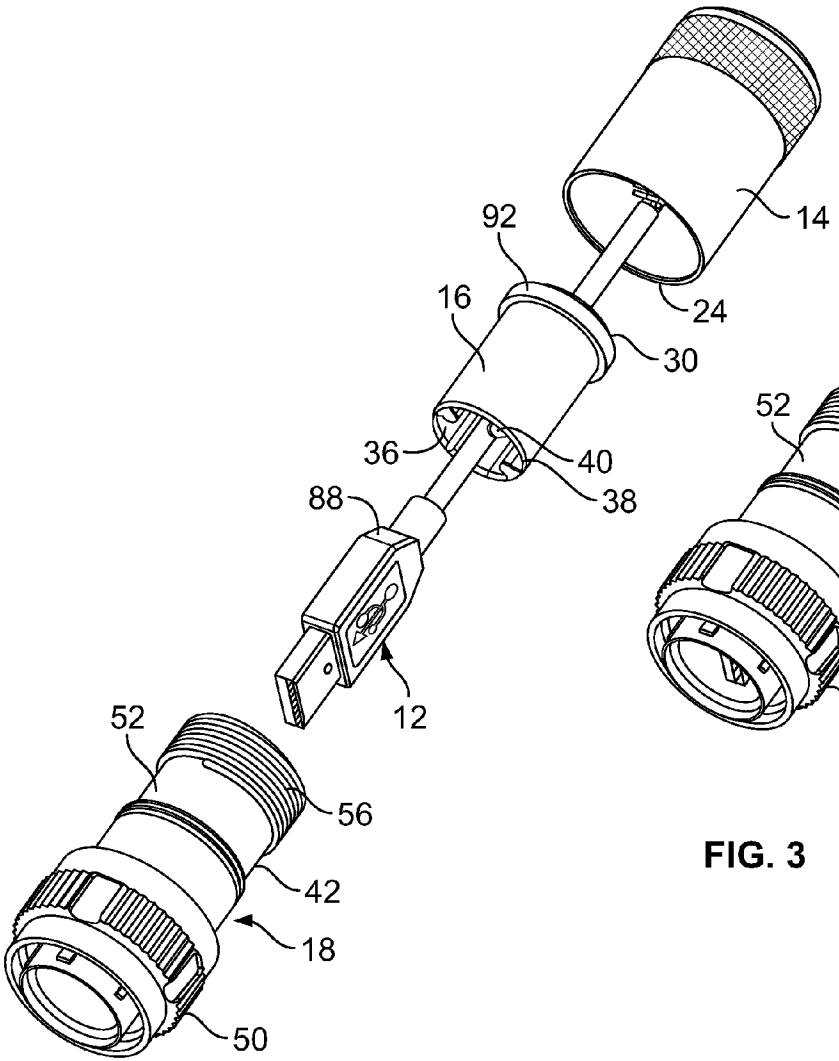
FIG. 2 is an exploded perspective view of the plug assembly, similar to that of FIG. 1, with the plug adaptor assembly assembled.
Figure 5:
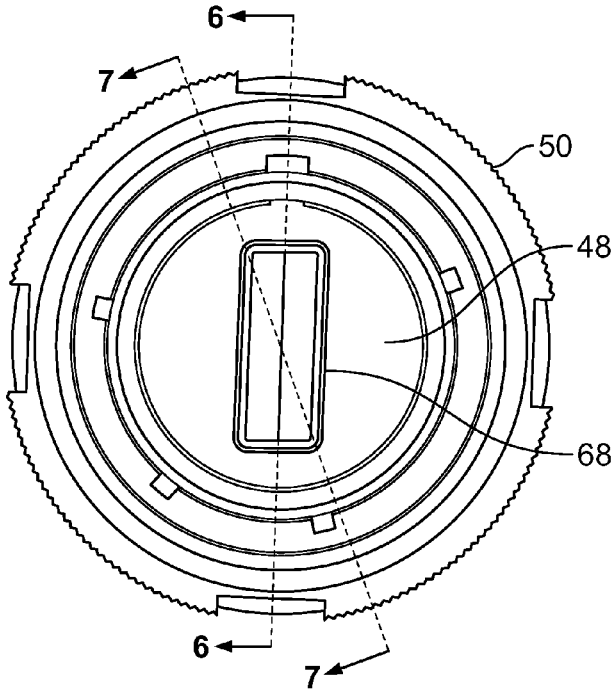
FIG. 5 is an end view of the fully assembled plug assembly of FIG. 4.

A plug assembly 10 for use with a USB connector 12 is shown. As best shown in FIG. 2, the plug assembly 10 has a protective shell 14, a sealing member 16 and a plug adapter assembly 18.

The protective shell 14 is made from metal or other electrically conductive material which has the strength characteristics required. The protective shell 14 has a generally cylindrical configuration. As best viewed in FIGS. 2A and 12, a back surface 20 of the protective shell 14 has an opening 22 which is dimensioned to receive the USB connector 12 and attached cable 24 therethrough. The protective shell 14 has threads 26 positioned about the circumference of an inner surface. The threads 26 are positioned between a front surface 28 and the back surface 20 of the protective shell 14.

As shown in FIGS. 1, 2, 2A and 12, the sealing member 16 has a cylindrical shape which is dimensioned to be received in the protective shell 14. The sealing member 16 has a back wall 30 with an opening 32 that is dimensioned to be slightly smaller than the diameter of the cable 24. A longitudinal slit 34 is provided in the sealing member 16. A connector-receiving opening 36, which is defined by an inner surface of the sealing member, extends from a front surface 38 of the sealing member 16 to the back wall 30. The inner surface is tapered, so that the connector-receiving opening 36 has a larger diameter proximate the front surface 38 and a smaller diameter proximate the back wall 30. The sealing member 16 is made of elastomer, rubber or other material which has the compliant and moisture resistant properties necessary. Projections 40 extend from the inner surface into the connector-receiving opening 32. The projections 40 cooperate with the USB plug or connector 12 when the connector 12 is inserted therein.

Figure 1:
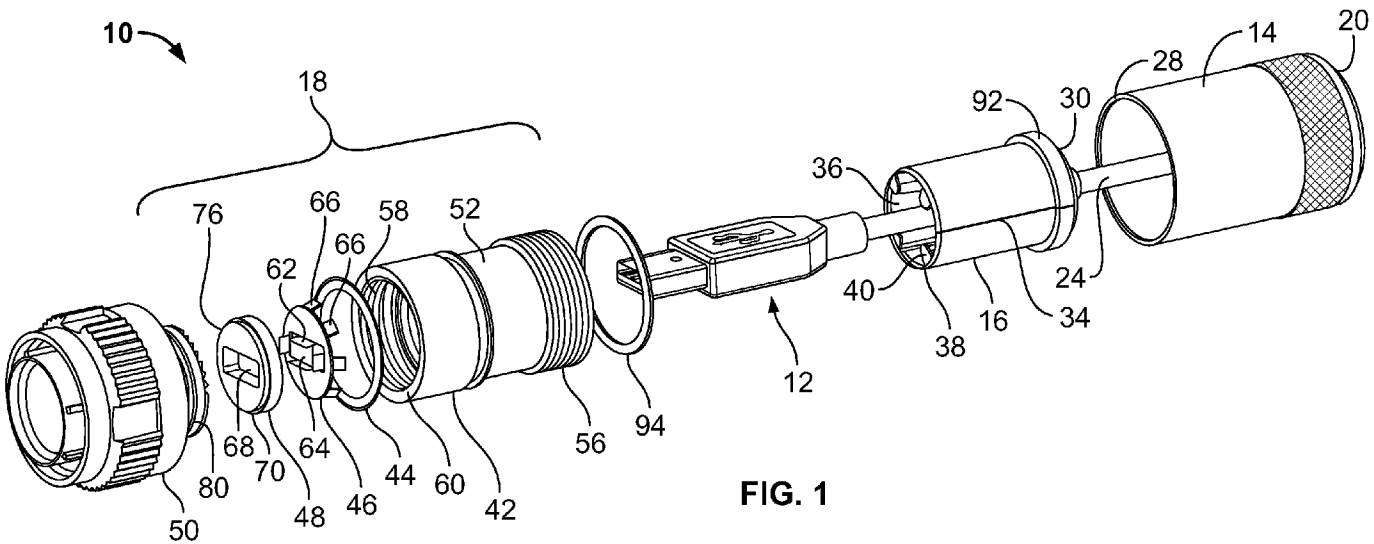
FIG. 1 is an exploded perspective view of an embodiment of a plug assembly for use with a USB connector according to the present invention.
Figure 12:
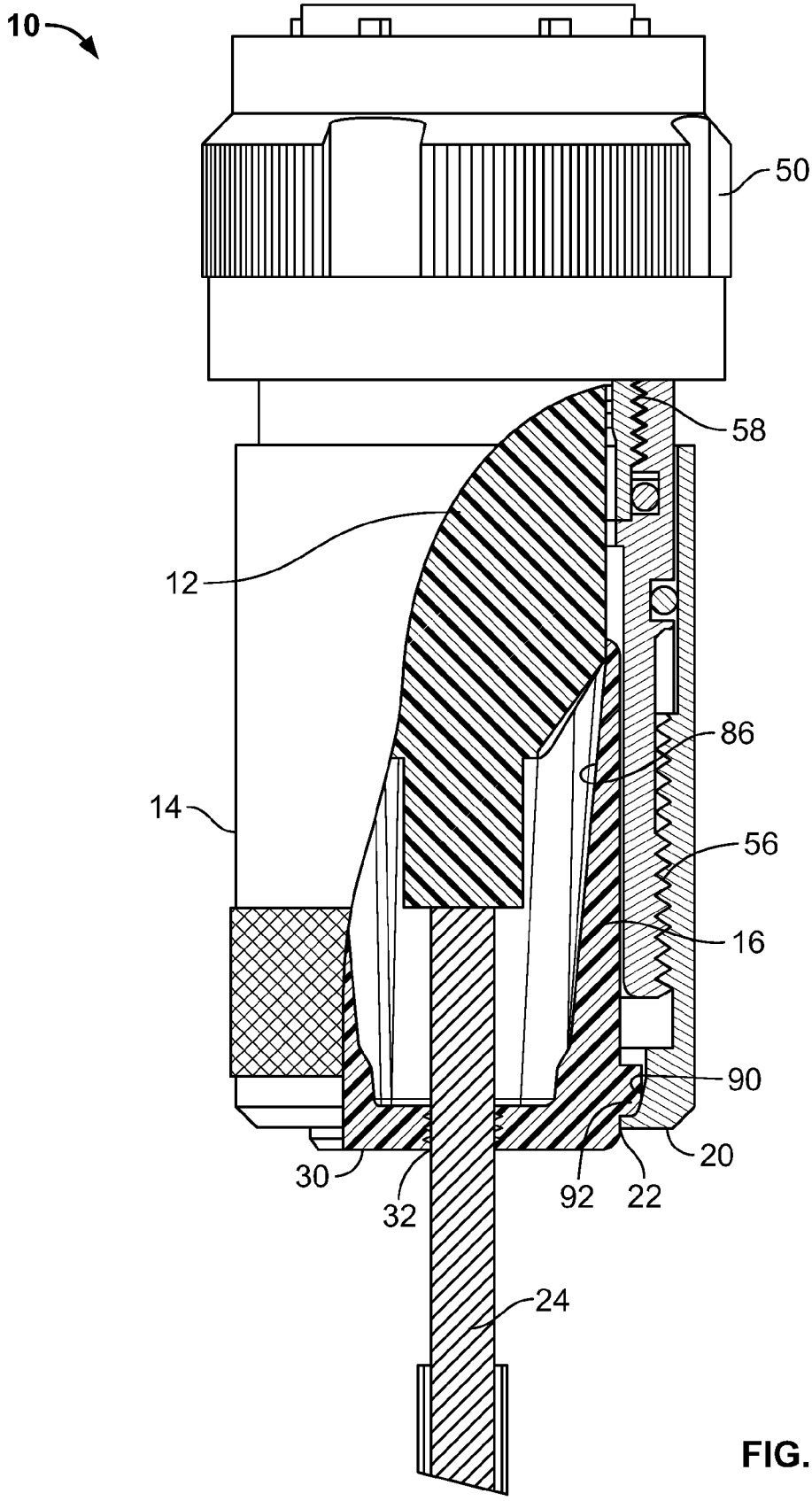
FIG. 12 is a partially cut away view of the assembled plug assembly showing the interaction between the sealing member and the particular USB connector positioned therein.

As best shown in FIG. 1, the plug adapter assembly 18 has a plug body 42, an O-ring 44, a system ground member 46, a seating member 48 and a circular mating assembly 50. The plug body 42 is generally cylindrical in configuration. As shown in FIGS. 1, 2 and 2A, the plug body 42 has an outside surface 52 with a diameter that is varied along its length. However, other configurations of the outside surface 52 are anticipated. Referring to FIG. 2A, an inside surface 54 of the plug body 42 has a basically uniform diameter to allow for the insertion of the USB connector 12 therein. The plug body 42 has outward facing threads 56 provided on the outside surface 52 proximate a back end thereof. The outward facing threads 56 cooperate with the threads 26 of the protective shell 14 when the plug body 42 and protective shell 14 are mated together, as best shown in FIG. 12. Inward facing threads 58 are provided proximate the front end 60 of the inside surface 54 of the plug body 42. The inside surface 54 has a slightly larger diameter in the area of the inward facing threads 58.

Figure 8:
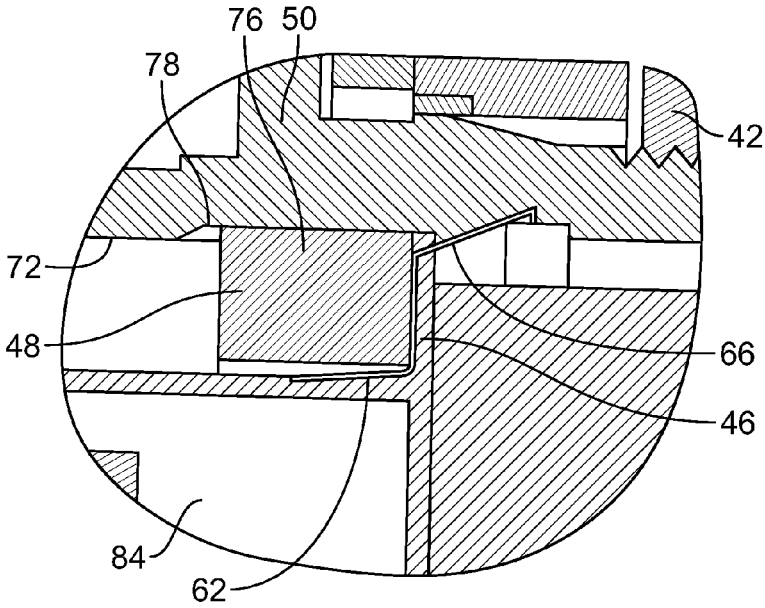
FIG. 8 is an enlarged cross-section view of the grounding member of FIG. 6.

As best shown in FIGS. 1 and 8, the system ground member 46 is a circular plate-like member which has inner tabs 62 which extend from an opening 64 in the center of the circular plate. The opening 64 is rectangular and is dimensioned to receive the mating portion of the USB connector 12 therethrough. The inner tabs 62 are integral with and extend from each side of the opening 64. The inner tabs 62 are stamped and formed from the material which is displaced to form the opening 64 in the circular plate. Outer tabs 66 are formed about the perimeter of the circular plate. The outer tabs 66 are spaced periodically about the entire perimeter of the circular plate. The inner tabs 62 are bent to extend away from the plug body 42 and the outer tabs 66 are bent to extend toward the plug body 42 when the plug adapter assembly 18 is fully assembled. The system ground member 46 is made from metal or other electrically conductive material which has the resilient or spring characteristics required.

A seating plane plate or seating member 48 has a circular cross-section which is slightly larger than the circular cross-section of the system ground 46 (as best shown in FIG. 8). The seating member 48 has an opening 68 in the center of the plate. The opening 68 is rectangular and extends through the plate. The opening 68 is dimensioned to receive the inner tabs 62 of the system ground member 46 therein. A recess 70 is provided on a front surface of the seating member 48. The recess 70 extends about the periphery of the front surface.

Figure 6:
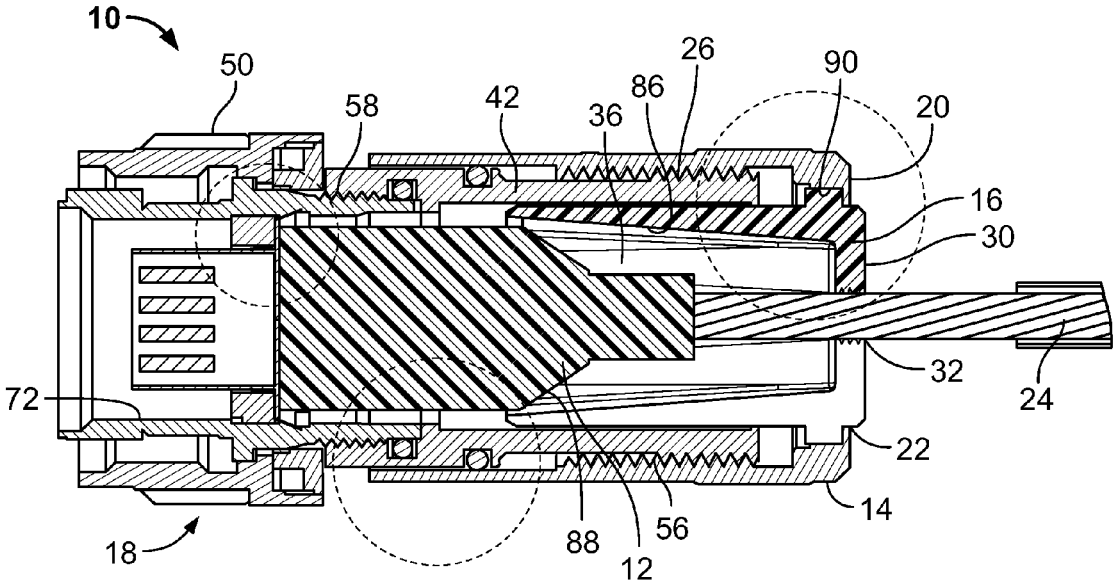
FIG. 6 is a cross-section view of the fully assembled plug assembly taken along the line of 6-6 of FIG. 5.
Figure 7:
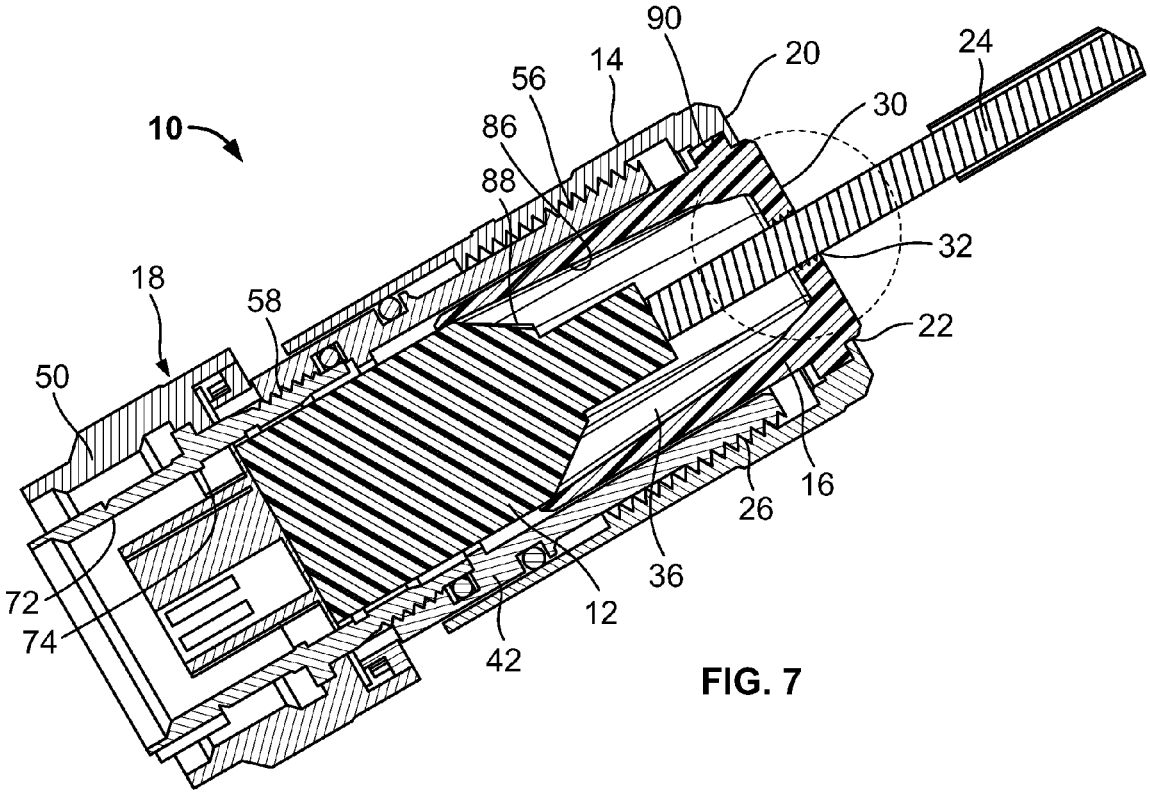
FIG. 7 is a cross-section view of the fully assembled plug assembly taken along the line of 7-7 of FIG. 5.

The circular mating assembly 50 has means for connecting to a mating assembly (not shown). Referring to FIGS. 6-8, the circular mating assembly 50 has an inner opening 72 which is dimensioned to receive the seating member 48 and the system ground member 46 therein. As shown in FIG. 6, the inner opening 72 has a shoulder 74 which cooperates with the recess 70 on the front surface of the seating member 48 to maintain the seating member 48 in proper position in the inner opening 72 of the circular mating assembly 50. The seating member 48 has an alignment protrusion 76 which cooperates with a recess 78 (FIG. 8) in a wall of the inner opening 72 to properly align the seating member 48 relative to the circular mating assembly 50. A binding agent is applied to the recess 70 of the seating member 48 to affix the seating member 48 to the circular mating assembly 50.

Once the seating member 48 has been properly positioned in the inner opening 72 of the circular mating assembly 50 and the binding agent has cured, the system ground member 46 is inserted into the inner opening 72. As is best shown in FIG. 8, the inner tabs 62 of the system ground member 46 are inserted into the opening 68 of the seating member 48. The outer tabs 66 resiliently engage and exert pressure on the surface of the inner opening 72. Due to the configuration of the outer tabs 66, the system ground member 46 can be easily inserted into the inner opening 72, but the removal is made difficult as the ends of the outer tabs 66 will dig into the surface of the inner opening 72. The system ground member 46 is therefore maintained in the position shown in FIG. 8 by the seating member 48 and the outer tabs 66 of the system ground member 46. The pressure exerted by the resilient outer tabs 66 on the surface of the inner opening 72 also insures that the outer tabs 66 will wipe away any contamination on the surface of the inner opening 72, thereby providing a positive electrical connection between the outer tabs 66 and the surface of the inner opening 72.

The O-ring 44 is positioned over back threads 80 of the circular mating assembly 50, and the plug body 42 is screwed onto the circular mating assembly 50, as shown in FIGS. 2, 2A and 7. As this occurs, the O-ring 44 provides a seal between the circular mating assembly 50 and the plug body 42.

The USB connector 12 is positioned through a back opening 82 of the plug body 42 and into the opening 68 of the seating member 48, as shown in FIG. 8. The inner tabs 62 of the system ground member 46 engage and make electrical connection with a shield 84 of the USB connector 12.

Figure 3:
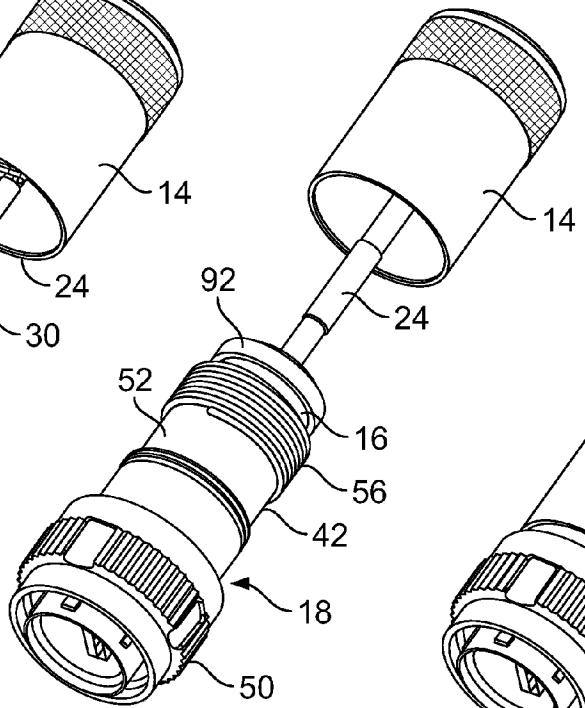
FIG. 3 is a perspective view of the plug assembly showing the protective shell removed from the plug adaptor assembly.
Figure 11:
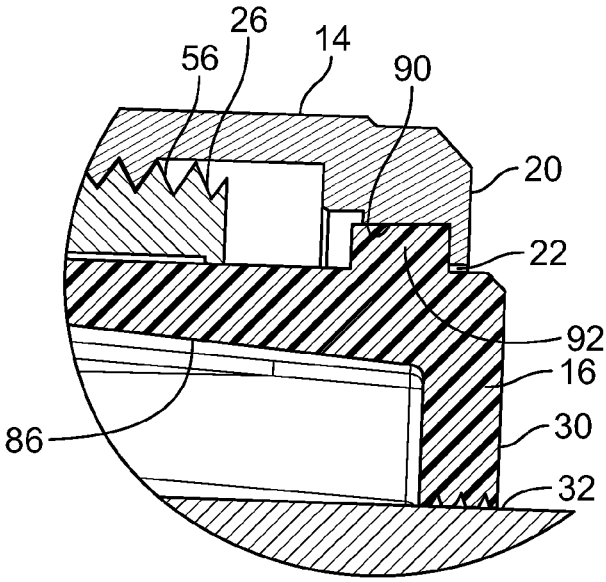
FIG. 11 is an enlarged cross-section view of a portion of FIG. 6 showing the protective shell in cooperation with the sealing member.

With the USB connector 12 properly positioned, the sealing member 16 is inserted onto the cable 24. The sealing member 16 is positioned on the cable 24 by inserting the cable 24 through the slit 34 and into the opening 32 of the sealing member 16. Because of the respective diameters of the opening 32 through the back wall 30 of the sealing member 16 and the cable 24, the opening 32 will tightly grip the cable 24 to form a seal therebetween. If the opening 32 were dimensioned to be significantly larger than the cable 24, the sealing member 16 would not form a proper seal with the cable 24, thereby making its use in harsh military, aerospace and industrial applications problematical. Once positioned on the cable 24, the sealing member 16 is moved into the plug body 42, as shown in FIG. 3. With the sealing member 16 properly positioned, the protective member or shell 14 is threaded onto the plug body 42, trapping the sealing member 16 therebetween and causing the sealing member 16 to be forced toward the front end 60 of the plug body 42. This causes the tapered inner surface 86 (FIG. 12) of the sealing member 16 to engage the transition area 88 of the USB connector 12, which in turn causes the USB connector 12 to be forced into the opening 64 of the system ground member 46. As shown in FIGS. 2A and 11, the protective shell 14 has sloped surfaces 90 proximate the back surface 20 which cooperate with projections 92 of the sealing member 16 to insure that the sealing member 16 is pushed against the cable 24 to provide a proper seal. As the protective shell 14 is threaded onto the plug body 42, the wall of the plug body 42 is forced inward, thereby causing the wall to exert pressure on the sealing member 16. This pressure causes the tapered inner surface 86 to cause the USB connector 12 to be moved further toward the circular mating assembly 50, thereby positively seating the USB connector 12 in the opening 64 of the system ground member 46. The configuration of the tapered inner surface 86 allows all types of USB connectors 12 to be used therewith, regardless of the particular configuration of the housing of the USB connector.

A second compressible member or second O-ring 94 (as shown in FIGS. 1, 6, 7 and 9) is also provided between the protective shell 14 and plug body 42 to facilitate sealing of the plug assembly 10.

Figure 4:
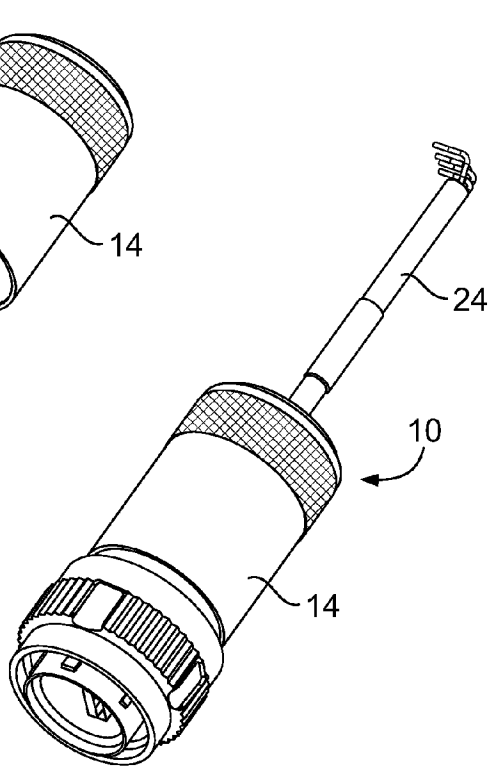
FIG. 4 is a perspective view of the fully assembled plug assembly of FIG. 1.

The fully assembled plug assembly 10 with the USB connector 12 inserted therein is shown in FIGS. 4 and 12. As best shown in FIG. 12, the tapered inner surface 86 of the sealing member 16 engages the transition area 88 of the USB connector 12 as previously described.

With the plug assembly 10 fully assembled, the conductive shell of the USB connector 12 is placed in electrical engagement with the shell of the circular plug assembly 50 via the inner tabs 62 and outer tabs 66 of the system ground member 46, as shown in FIG. 8. This allows for a grounding path to be provided between the USB connector 12 and the system to which the mating assembly 50 is mated. This provides additional shielding to prevent the degradation of the signals transmitted by the USB connector 12.

Figure 9:
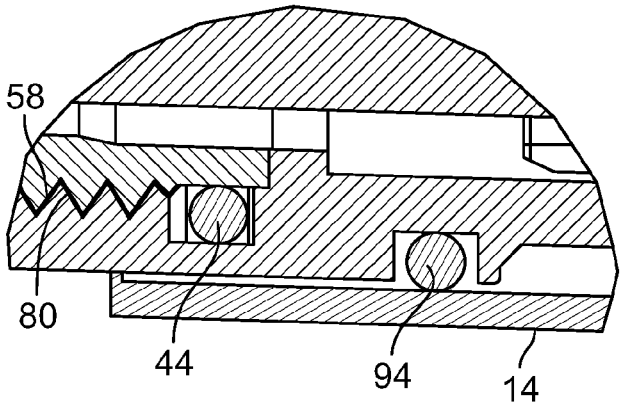
FIG. 9 is an enlarged cross-section view of a portion of FIG. 6 showing the interface between a circular mating assembly, a plug body and the protective shell.
Figure 10:
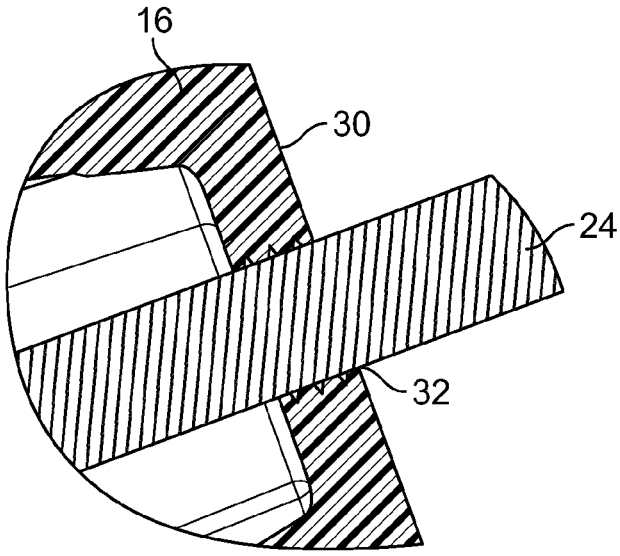
FIG. 10 is an enlarged cross-section view of a portion of FIG. 7 showing the engagement of a sealing member with a cable.

FIG. 9 illustrates the use of the O-rings 44, 94 to provide additional sealing for the assembled plug assembly 10 which allows the plug assembly 10 to be used in harsh environments. FIGS. 10 and 11 illustrate various details of the sealing member 16 which also provide additional sealing to protect the plug assembly 10 and the USB connector 12 in harsh military, aerospace and industrial environments.

Several of the advantages of this inventions include: the plug assembly may be installed over a terminated USB connector; the plug assembly provides additional shielding for the USB connector which allows the USB connector to be used in military, aerospace, industrial or other applications in which signal degradation is a concern; the plug assembly is easily installed in the field, as the plug adapter assembly may be preassembled during manufacture; and the plug assembly provides sealing for the USB connector which allows the USB connector to be used in environmental conditions which are not conducive to the longevity of an unprotected connector.

While the invention has been described with reference to a preferred embodiment, it will be understood by those skilled in the art that various changes may be made and equivalents may be substituted for elements thereof without departing from the scope of the invention. As an example, the seating plane plate may not have a binding agent applied thereto, but may be retained in position by the cooperation of the shoulder of the inner opening of the circular mating assembly and the outer tabs of the system ground. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A plug assembly for housing a Universal Serial Bus (USB) connector, the plug assembly comprising:

a protective shell having an opening which is dimensioned to receive the USB connector and attached cable therethrough;

a sealing member dimensioned to be received in the opening of the protective shell, the sealing member having a connector receiving opening which extends from a front surface of the sealing member to proximate a back surface of the sealing member, the connector receiving opening being tapered such that diameter of the connector receiving opening is larger proximate the front surface and smaller proximate the back surface;

a plug adapter assembly having a plug body, a seating member and a mating assembly, the plug body having a generally cylindrical opening which extends therethrough which is dimensioned to receive the USB connector therein, the seating member having a seating opening which is dimensioned to cooperate with a mating portion of the USB connector, the mating assembly having a mating opening for positioning the seating member, the mating assembly being dimensioned to engage a mating connector to properly position the mating portion of the USB connector relative to the mating connector;

whereby the protective shell, the sealing member and the plug adaptor assembly can be installed on the USB connector after the USB connector has been terminated to the cable.

2. The plug assembly as recited in claim 1, wherein the protective shell has threads positioned about the circumference of the opening, the plug body has outwardly facing threads, the outwardly facing threads of the plug body cooperate with the threads of the protective shell to maintain the protective shell in engagement with the plug body.

3. The plug assembly as recited in claim 2, wherein slopped surfaces proximate a back surface of the protective shell engage the sealing member to insure that the sealing member provides a proper seal.

4. The plug assembly as recited in claim 1, wherein the plug adapter assembly has a ground member, the ground member having inner tabs and outer tabs, the inner tabs extending from a ground member opening, the ground member opening being dimensioned to receive the mating portion of the USB connector therethrough, the outer tabs being formed about the perimeter of the ground member, the outer tabs are bent to extend toward the plug body, the seating opening of the seating member dimensioned to receive the inner tabs of the grounding member therein, wherein a conductive shell of the USB connector is placed in electrical engagement with the plug adapter assembly via the inner and outer tabs of the ground member, allowing for a grounding path to be provided between the USB connector and the mating connector to which the plug adapter assembly is mated.

5. The plug assembly as recited in claim 4, wherein the ground member is a circular plate, the inner tabs extend from the ground member opening in the center of the circular plate which is dimensioned to receive the mating portion of the USB connector therethrough, the inner tabs are integral with and extend from each side of the ground member opening, the outer tabs are formed about the perimeter of the circular plate and are spaced periodically about the entire perimeter of the circular plate, the inner tabs extend away from the plug body and the outer tabs extend toward the plug body.

6. The plug assembly as recited in claim 5, wherein the seating member has a circular cross-section which is larger than the circular cross-section of the ground member, the positioning opening of the seating member receives the inner tabs of the ground member therein.

7. The plug assembly as recited in claim 1, wherein a first compressible member is positioned between the plug body and the mating assembly to provide a seal therebetween, a second compressible member is provide between the plug body and the protective shell to provide a seal therebetween, whereby the sealing member, the first compressible member and the second compressible member provide the plug assembly with sealing to protect the USB connector in harsh environmental conditions.

8. A plug assembly for housing a USB connector, the plug assembly comprising:

a protective shell having an opening which is dimensioned to receive the USB connector and attached cable therethrough;

a sealing member dimensioned to be received in the opening of the protective shell, the sealing member having a connector receiving opening which extends from a front surface of the sealing member to proximate a back surface of the sealing member, the connector receiving opening being tapered such that diameter of the connector receiving opening is larger proximate the front surface and smaller proximate the back surface;

a plug adapter assembly having a plug body, a seating member and a ground member, the ground member having inner tabs and outer tabs, the inner tabs extending from a ground member opening, the ground member opening being dimensioned to receive a mating portion of the USB connector therethrough, the outer tabs being formed about the perimeter of the ground member, the outer tabs are bent to extend toward the plug body, the seating member having a seating opening dimensioned to receive the inner tabs of the ground member therein;

wherein a conductive shell of the USB connector is placed in electrical engagement with the plug adapter assembly via the inner and outer tabs of the ground member, allowing for a grounding path to be provided between the USB connector and a mating connector to which the plug adapter assembly is mated.

9. The plug assembly as recited in claim 8, wherein the plug body has outwardly facing threads, the protective shell has threads positioned about the circumference of the opening, the outwardly facing threads of the plug body cooperate with the threads of the protective shell to maintain the protective shell in engagement with the plug body.

10. The plug assembly as recited in claim 9, wherein slopped surfaces proximate a back surface of the protective shell engage the sealing member to insure that the sealing member provides a proper seal.

11. The plug assembly as recited in claim 8, wherein the ground member is a circular plate, the inner tabs extend from an rectangular opening in the center of the circular plate which is dimensioned to receive the mating portion of the USB connector therethrough, the inner tabs are integral with and extend from each side of the opening, the outer tabs are formed about the perimeter of the circular plate and are spaced periodically about the entire perimeter of the circular plate, the inner tabs extend away from the plug body and the outer tabs extend toward the plug body.

12. The plug assembly as recited in claim 11, wherein the seating member has a circular cross-section which is larger than the circular cross-section of the ground member, the seating opening of the seating member receives the inner tabs of the grounding member therein.

13. The plug assembly as recited in claim 8, wherein a first compressible member is positioned between the plug body and a mating assembly of the plug adapter assembly to provide a seal therebetween, a second compressible member is provide between the plug body and the protective shell to provide a seal therebetween, whereby the sealing member, the first compressible member and the second compressible member provide the plug assembly with sealing to protect the USB connector in harsh environmental conditions.

14. The plug assembly as recited in claim 8, wherein the plug body has a generally cylindrical opening which extends therethrough which is dimensioned to receive the USB connector therein, the seating opening of the seating member cooperates with the mating portion of the USB connector, the mating assembly of the plug adapter assembly has a mating opening for positioning the seating member and engaging a mating connector to properly position the mating portion of the USB connector relative to the mating connector, whereby the protective shell, the sealing member and the plug adaptor can be installed on the USB connector after the USB connector has been terminated to the cable.

15. A plug assembly for housing a USB connector, the plug assembly comprising:

a protective shell having an opening which is dimensioned to receive the USB connector and attached cable therethrough;

a sealing member dimensioned to be received in the opening of the protective shell, the sealing member having a connector receiving opening which extends from a front surface of the sealing member to proximate a back surface of the sealing member, the connector receiving opening being tapered such that diameter of the connector receiving opening is larger proximate the front surface and smaller proximate the back surface;

a plug adapter assembly having a plug body and a mating assembly, the plug body having a generally cylindrical opening which extends therethrough which is dimensioned to receive the USB connector therein, the mating assembly having a mating opening for positioning a mating portion of the USB connector relative to a mating connector;

a first compressible member being positioned between the plug body and the mating assembly to provide a seal therebetween, a second compressible member being provide between the plug body and the protective shell to provide a seal therebetween, whereby the sealing member, the first compressible member and the second compressible member provide the plug assembly with sealing to protect the USB connector in harsh environmental conditions.

16. The plug assembly as recited in claim 15, wherein the plug body with outwardly facing threads, the protective shell has threads positioned about the circumference of the opening, the outwardly facing threads of the plug body cooperate with the threads of the protective shell to maintain the protective shell in engagement with the plug body.

17. The plug assembly as recited in claim 16, wherein slopped surfaces proximate a back surface of the protective shell engage the sealing member to insure that the sealing member provides a proper seal.

18. The plug assembly as recited in claim 15, wherein the plug adapter assembly has a ground member, the ground member having inner tabs and outer tabs, the inner tabs extending from a ground member opening, the ground member opening being dimensioned to receive the mating portion of the USB connector therethrough, the outer tabs being formed about the perimeter of the ground member, the outer tabs are bent to extend toward the plug body, a seating member having a seating opening dimensioned to receive the inner tabs of the grounding member therein, wherein a conductive shell of the USB connector is placed in electrical engagement with a shell of the plug adapter assembly via the inner and outer tabs of the ground member, allowing for a grounding path to be provided between the USB connector and a mating connector to which the plug adapter assembly is mated.

19. The plug assembly as recited in claim 18, wherein the ground member is a circular plate, the inner tabs extend from a rectangular opening in the center of the circular plate which is dimensioned to receive the mating portion of the USB connector therethrough, the inner tabs are integral with and extend from each side of the opening, the outer tabs are formed about the perimeter of the circular plate and are spaced periodically about the entire perimeter of the circular plate, the inner tabs extend away from the plug body and the outer tabs extend toward the plug body.

20. The plug assembly as recited in claim 19, wherein the plug adapter assembly has a seating member, the seating member has a circular cross-section which is larger than the circular cross-section of the ground member, the seating opening of the seating member receives the inner tabs of the ground member therein.

* * * * *